US005409171A

United States Patent [19]

Stangenberg et al.

[11] Patent Number: 5,409,171

[45] Date of Patent: Apr. 25, 1995

[54] DOCUMENT SHREDDER

[75] Inventors: Hartmut Stangenberg, Owingen; Rolf Gasteier, Bermatingen, both of Germany

[73] Assignee: Schleiche & Co. International Aktiengesellschaft, Germany

[21] Appl. No.: 119,446

[22] Filed: Sep. 9, 1993

Related U.S. Application Data

[63] Continuation of Ser. No. 854,946, Mar. 20, 1992, abandoned.

[30] Foreign Application Priority Data

Mar. 22, 1991 [DE] Germany ..... 41 09 467.0

[51] Int. Cl.[6] ..... B02C 18/16

[52] U.S. Cl. ..... 241/167; 241/236

[58] Field of Search ..... 241/236, 166, 167

[56] References Cited

U.S. PATENT DOCUMENTS

| | | | |
|---|---|---|---|
| 4,018,392 | 4/1977 | Wagner | 241/236 X |
| 4,489,897 | 12/1984 | Turner et al. | 241/167 |
| 4,565,330 | 1/1986 | Katoh | 241/236 |
| 4,919,345 | 4/1990 | Burlington et al. | 241/236 X |

FOREIGN PATENT DOCUMENTS

| | | | |
|---|---|---|---|
| 3312173 | 10/1984 | Germany | 241/236 |
| 8717883 | 12/1990 | Germany . | |
| 2061128 | 5/1981 | United Kingdom | 241/236 |

*Primary Examiner*—Frances Han
*Attorney, Agent, or Firm*—Quarles & Brady

[57] ABSTRACT

In a document shredder (1) each tool roller (7, 11) has two tool strippers (8, 9 or 12, 13) with in each case at least one support rod (15) and associated stripping bodies (28), so that two rows of stripping bodies (28) are provided in spaced manner in the circumferential direction of the tool roller (7, 11). In the vicinity of at least one longitudinal area of the tool roller (7, 11) particularly prone to bending deformation in place of the stripping body (28) is provided a support body (30), which positively connects the support rods (15) of two tool strippers (8, 9 or 12, 13) and the tool rollers (7, 11) and which can also act as a stripper. As a result of the frame-like locking of the tool roller and the support rods a significant stiffening occurs, which makes it possible to give smaller dimensions to the tool roller (7, 11) and/or the support rods (15).

32 Claims, 3 Drawing Sheets

DOCUMENT SHREDDER

This is a continuation of application Ser. No. 07/854,946, filed Mar. 20, 1992, now abandoned.

BACKGROUND OF THE INVENTION

The invention relates to a machine for destroying more particularly flat materials by cutting, tearing or comminuting such material. For this purpose, a feed-through gap is provided, in which the material is exposed to the working engagement and on either side of which can be located tool units, whereof at least one is elongated. These tool units can include at least one tool stripper or the like and are usually only fixed in the vicinity of their two ends on side plates or a body, which can form a bracket of a cutting mechanism.

Appropriately, in grooves of a tool unit performing a working movement, engage stripping bodies, such as stripping fingers, stripping plates or the like of a tool stripper, which are mounted on one or more rods, e.g. on the side of the tool unit remote from the feed-through gap, the support rods being positionally rigid, but relatively easily interchangeably fixed in said or other areas, whereas the movable tool unit is movably fixed in said areas, but in bearings. Very high bending forces can act on the tool units, so that particularly those units bounding the feed-through gap must be correspondingly dimensioned, so that under the working loads which occur, no deformation by bending takes place. Although such bending deformation would in the case of a tool roller lead to its additional supporting on at least one stripper, this must be avoided such as by limiting the driving torque, because this would lead to an immediate reciprocal seizing of the interengaging surfaces, which are not designed for running on one another under supporting forces, and which instead, for maintaining their functionality, must rest without pressure on one another or with a minimum tolerance spacing.

If two or more support rods are distributed around the tool axis and are interconnected by means of stripping bodies, there has hitherto been no reciprocal supporting of said rods between the ends, at least with respect to the working loads which occur, because the support rods have been so dimensioned that under the working loads they cannot be deformed by bending to such an extent that, as a result, the bending forces would be transferred to the in each case other rod.

A generous dimensioning of the rod-like support parts is particularly necessary if it is required to process easily agglomerating materials, such as plastic sheets, because they form in the feed-through gap, or on the stripping areas, tough blockages which do not self-clear and can therefore lead to extremely high spreading or transverse forces. The strong dimensioning is disadvantageous both due to the increased size and weight of the machine and also with respect to the tool rollers due to the smaller roller curvature and larger radial lever arm, which makes the detachment of the material more difficult and consequently requires a higher driving moment and therefore a correspondingly geared down driving gear.

SUMMARY OF THE INVENTION

An object of the invention is to provide a document shredder of the aforementioned type, which avoids the disadvantages of known constructions and which in particular with a relatively simple construction reduces the bending strength of at least one tool unit without there being any risk of a bending deformation limiting functionality under the working loads which occur.

According to the invention, this object is achieved by a single tool unit or at least two to all the existing tool units being provided with a single, additional bending securing means or several such bending securing means to prevent bending deformation, said securing means being spaced from their position securing means in such a way that the securing force increases with increasing bending deformation. The maximum bending deformations to be absorbed in troublefree manner become extremely small, namely well below 1 mm or 2/10 or 1/10 mm, because then even when fixed strippers or the like engaging in an arrangement with a tool unit movable in grooves, there is no need to fear such a high reciprocal friction that damage, such as due to jamming against one another of sliding surfaces could occur. It is also possible to provide support means with rolling engagement, such as by rolling members or rollers. This is particularly advantageously possible if strippers are alternatingly arranged, i.e. strippers for adjacent cutting disks are circumferentially displaced. The rolling supporting means can run in the grooves between the cutting disks or tool rings, or optionally on the circumference thereof. The securing means support or engage the tool unit during a non-stress state.

As additional bending securing means, it is possible to use numerous securing means types alone or in random combination, and the arrangement is appropriately such that in addition to the components needed for the operation of the machine, no further components are needed or their number can be greatly reduced, although the bending strength of each of the additionally secured, elongated support parts is so reduced by corresponding weak dimensioning that said support part would be deformed beyond the indicated amount if it was exposed to the operating forces acting thereon without the additional bending securing means.

For this purpose, various types of bending securing means can be used individually or in random combination. For example, a mechanical support securing means is appropriate, which additionally supports the elongated support part on the outside or inside against the bending pressure which occurs. If the support part performs a working movement relative to the body, then supporting appropriately takes place by means of the surfaces of a step bearing relative to the body, which surfaces are spaced from the position securing means with respect to the body and are appropriately located roughly symmetrically to the center between said position securing means.

As an additional bending securing means, it is also possible to stiffen at least one tool unit or at least one support part by profiling, appropriate hardening, etc. A substantially clearance-free interlocking of at least two tool units or support parts is also possible with respect to the bending forces which occur. An additional bending securing means also be obtained in that surfaces running on one another are provided with friction reduction means and consequently the maximum transverse or bending loads occurring under the working conditions undergo drastic reductions. In the case of a support securing means, supporting, instead of taking place directly radially relative to a fixing component of the body, appropriately occurs via at least one longitudinal part, which is optionally easily detachably or replaceably connected to the body longitudinally spaced from the support point engaging on the tool unit.

If no separate components are used, then the longitudinal part can be formed by a tool unit or its support part, which is only directly fixed relative to the body in the vicinity of said position securing means. Thus, two or more or all the tool units on one side of the feed-through gap can be reciprocally stiffened by one or more longitudinally spaced, adjacent transverse connections and in said union can have a greatly increased bending strength despite the smaller dimensions.

To achieve a support securing, particularly for a tool roller, it is conceivable to provide one, several or all the stripping bodies in the form of a through, plate-like support body uniformly distributed over the entire length of the supported tool unit and with the surfaces running on the outer circumference of the roller constructed as shell-like step bearing surfaces. Instead of running on the outermost outer circumference of the tool roller, they run on the outer circumference of a diameter-reduced roller core.

The support bodies can be arranged in self-orienting manner with respect to the roller in the longitudinal direction. It can also be appropriate, besides such stripping bodies, to provide separate support bodies, which can embrace the roller over a larger arc angle than each stripping body alone, and appropriately in the circumferential direction or in a single longitudinal portion of the roller, two stripping bodies are successively arranged, which embrace the roller together over a larger arc angle than the support body. If the support body forms on one or both ends of its step bearing surface a scraping or stripping edge, it can be so displaced in the circumferential direction with respect to those of the differently shaped stripping body that they are set back with respect to the associated rotation direction compared with those of the other stripping bodies and consequently said stripping edges engage in time-succeeding manner.

The circumferentially reciprocally displaced stripping bodies can be mounted on a separate support part individually and without connection to the other support part, while the support bodies are mounted on at least two circumferentially reciprocally displaced support parts, which in each case carry a row of stripping bodies and which can in each case be formed by two or more radially or circumferentially roughly parallel juxtaposed individual bars. The step bearing surface of the stripping body can be dimensioned in such a way that in the bending-free state of the particular tool unit, it engages with greater pressure on one or more of the support parts than would be the case with the stripping bodies alone, so that any bending forces are initially and more strongly transferred to the support bodies.

The invention creates a possibility of providing cutting mechanisms which, in the case of a better cutting action require a smaller input power and have reduced wear. This more particularly applies with regards to their suitability for processing plastic-containing data carriers. A very narrow gap dimensioning between the cutting blades is then particularly important, because due to the elastic end plastic characteristics of said materials, they can only be separated by a very clean cut. The narrow gap dimensioning also leads to increased wear, if the shredder-typical shock loading (e.g. in the case of locking due to excessively thick document bundles) occurs, and the cutting rollers could elastically deform. As a result of the sagging securing, in particular, the shock-caused sagging and other deformation are absorbed and diverted as directly as possible to the machine frame, namely at points where same is particularly effective, e.g. in the center of the cutting mechanism.

BRIEF DESCRIPTION OF THE DRAWINGS

These and other features can be gathered from the claims, description and drawings, and the individual features can be realized singly or in the form of subcombinations in an embodiment of the invention and in other fields and can represent advantageous, independently protectable constructions for which protection is hereby claimed. An embodiment of the invention is described in greater detail hereinafter relative to the drawings, wherein show:

DETAILED DESCRIPTION OF THE DRAWINGS

Figure 1:
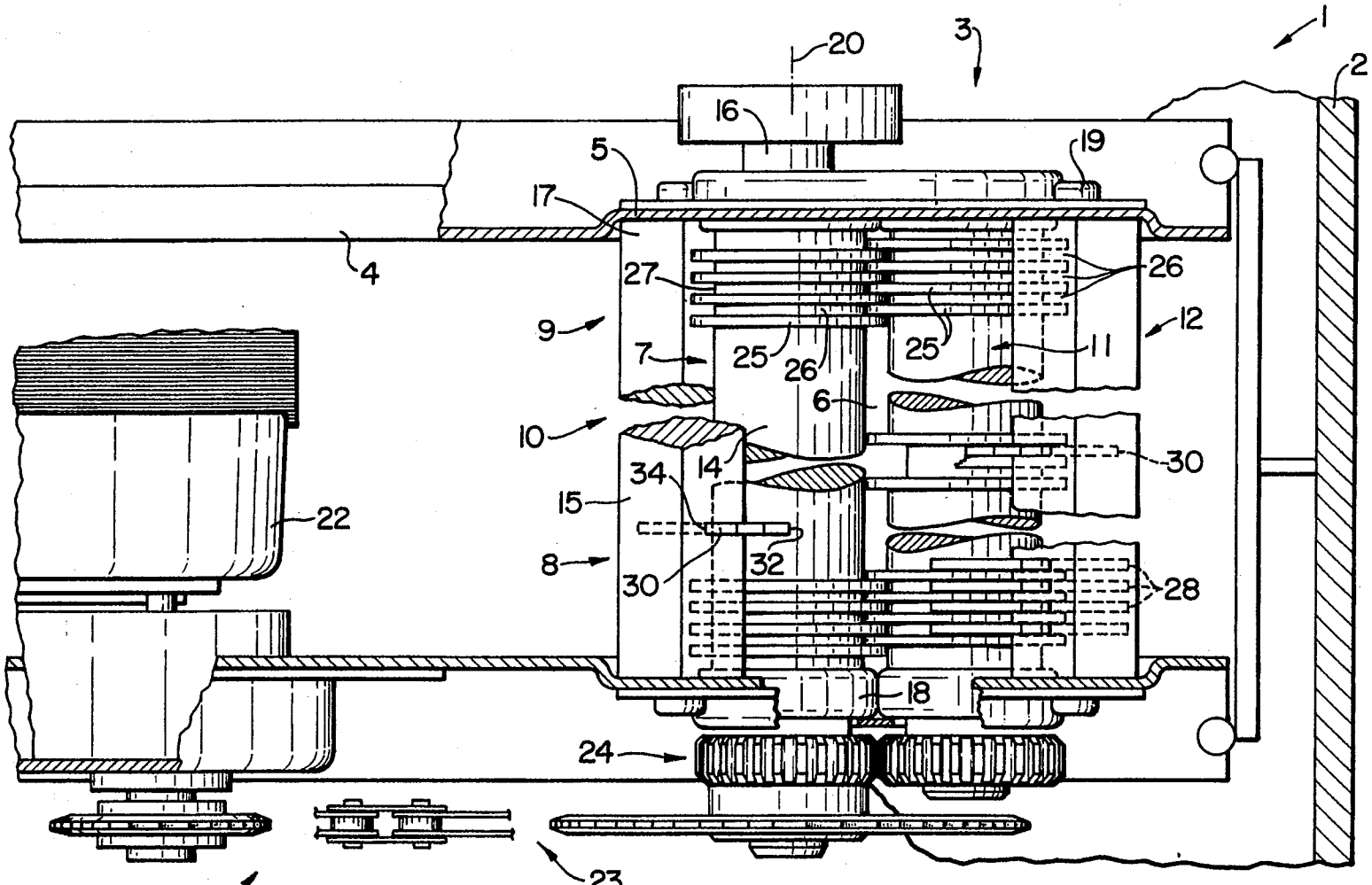
FIG. 1 A detail of an inventive document shredder in part sectional plan view.
Figure 2:
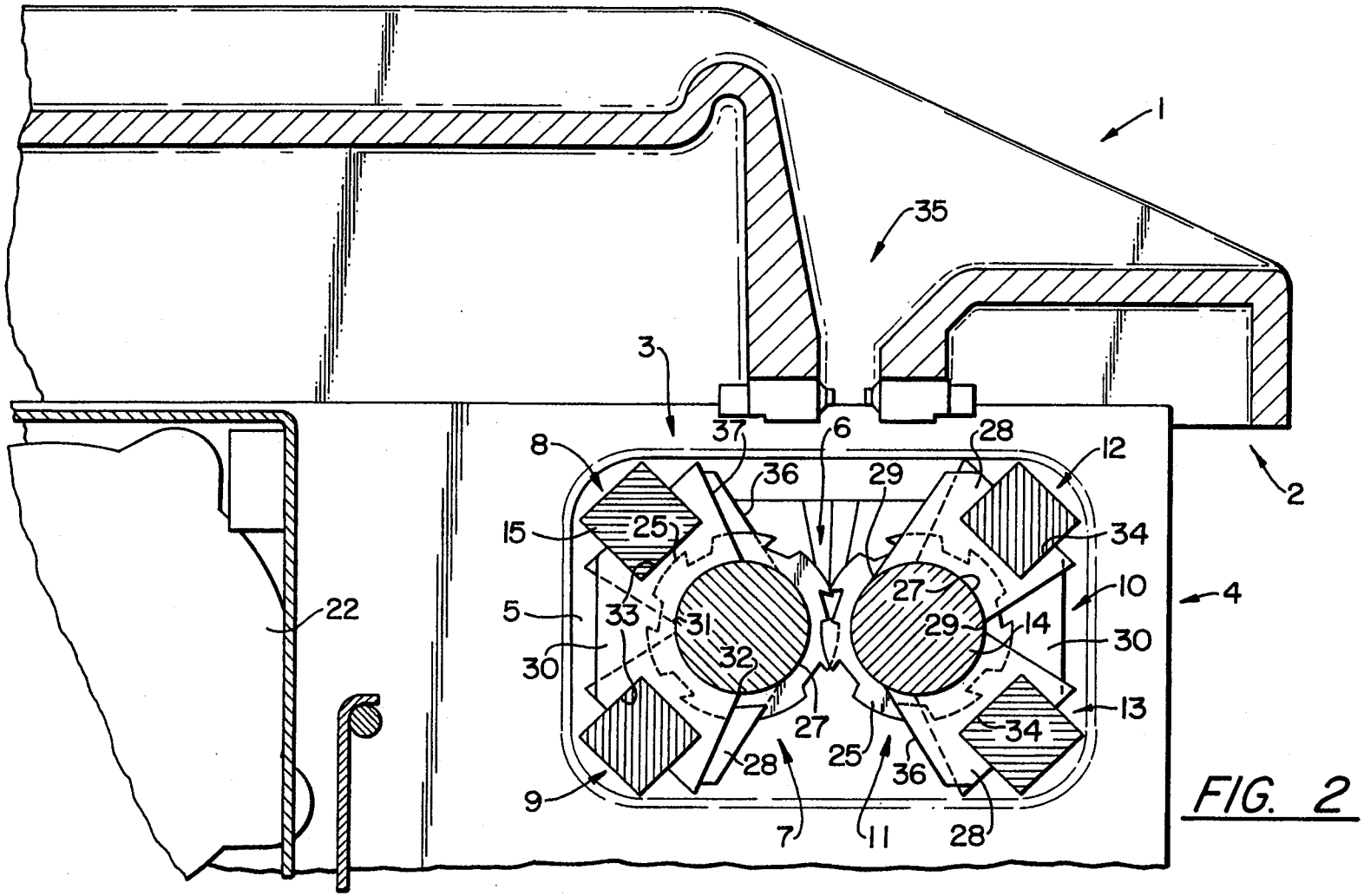
FIG. 2 A cross-section through the detail of FIG. 1.

The document shredder 1 bas almost completely encapsulated in a casing 2 a comminuting mechanism 3 in the form of a closed subassembly, which contains a body 4 with two facing profile support plates 5 and which is fixed to a base. The comminuting mechanism 3 defines a working gap 6 through which passage takes place substantially vertically; which on one side is bounded by tool units 7 to 9 and on the other side by tool units 11 to 13; and whose gap width is kept substantially constant by a securing device 10 under all working conditions which occur.

Two tool units are tool rollers 7, 11, which directly define the working gap 6 and are located in a common axially plane at right angles to the vertical gap plane. With each of these tool rollers 7, 11 are associated outside the working gap 6, two of the further tool units, namely the tool strippers 8, 9 or 12, 13, which are arranged substantially symmetrically to the axial plane and the gap plane. All the tool units have support bodies 14, 15 roughly parallel to one another or to said planes or to their common straight lines, and which in the case of the tool rollers 7, 11, are formed by the tool or roller cores 14, and in the case of the tool strippers 8, 9 or 12, 13, by rods, and can have over their entire length substantially approximately constant cross-sections.

At least with respect to their central axes, said support bodies are fixed with respect to the support plates 5 in the vicinity of their ends 16, 17. Each end of the tool rollers 7, 11 formed by the tool core 14 traverses a shaft bearing 18 which is secured on one of the two support plates 5 and which can be released for replacing the tool roller 7, 11. Each end 17 of each fixed support rod 15 is secured with its end face against the inside of the associated support plate 5 by means of at least one fastening member 19, e.g. such a screw and is therefore fixed in easily detachable or replaceable manner between the support plates 5.

Each support body of the tool units substantially completely located between the support plates 5 has no direct support between said plates 5 relative to the body 4, although the support rods 15 can form stiffening transverse borders of a support frame for the body 4, whose longitudinal borders are formed by the support plates 5 or the support profiles forming the latter. For one tool unit 7, an approximately horizontal central axis 20 is indicated and the central axes of all the other tool units are parallel thereto.

Parallel thereto is also provided a drive 21, which has a motor 22 fixed to the inside of a support plate 5, and on the outside of said support plate, a reduction gear 23, in the form of a one-stage roller chain gear. The driven wheel of this gear 23 is fixed on the outside of said support plate 5 on the associated end of the tool roller 7 closer to the motor 22, the latter being located in said axial plane. Between said gear wheel and the closer support plate 5, a gear wheel of an intermediate gear 24 is fixed to its outside on the end of the tool roller 7 and meshes with a gear wheel of the other tool roller 11 in such a way that the two rollers 7, 11 can be contrarotated with roughly the same speed and directly drive-connected.

Each of the two tool rollers 7, 11 is, in cross-section, substantially identically constructed between the support plates 5 laterally bounding the working area or gap. Each roller core 14 has a plurality of longitudinally, equidistantly, successively and substantially circular tool rings 25, which project in ring disk-like manner past the outer circumference of the substantially cylindrical roller core 14. Between adjacent tool rings 25 is bounded a circular circumferential groove 26, whose planar groove sides are at right angles to the axis 20 and are formed by the end faces of the two tool rings 25 and whose groove width is chosen in such a way that one tool ring 25 can engage in substantially axial clearance-free manner between the groove sides. The groove bottom 27 of each groove 26 is formed by the cylindrical outer circumference of the roller core 14, the groove depth being a fraction of the diameter or radius of the core 14. In each groove 26 engages a tool ring 25 of the in each case other tool roller 7 or 11 in such a way that its outer circumference runs in virtually gap-free manner on the groove bottom 27.

In the represented embodiment, the tool rings 25 have, instead of a through circular outer circumference, interruptions thereon in the form of axial grooves, which extend roughly over half the radial ring height and through which each ring 25 forms on its outer circumference a plurality of tearing teeth. The tool rings 25 can be manufactured by ring disks mounted in substantially clearance-free manner on the roller core with spacing rings in each case inserted between them for determining the groove width and for forming the groove bottom 27, or the roller core 14 can be constructed in one piece with the tool rings 25, as a function of the demands made on the comminuting mechanism 3. The substantially closed working gap 6 resulting from the interengaging tool rings 25 forms the material passage through the cutouts on the circumference of the rings 25.

The tool strippers 8, 9 and 12, 13 or the support rod 15 thereof are roughly symmetrical to an axial plane that is inclined by approximately 45° to the cannon axial plane or the gap plane, so that the two tool strippers of each tool roller are reciprocally displaced with respect thereto by an arc angle of approximately 90°. Instead of providing as support bodies for the tool stripper, two or more spaced, parallel individual rods, which are reciprocally displaced radially to the tool roller or in the circumferential direction thereof, alternatively only a single support rod can be provided with a constant rectangular or square full cross-section over its length and whose side facing the associated roller axis is approximately at right angles to the associated axial plane and is only at a gap spacing from the outer circumference of the tool rings 25.

Each support rod 15 or each tool stripper carries a row of separate stripping bodies 28, which are congruently constructed in its longitudinal direction, and whereof in each case, one can so engage in each of the associated circumferential grooves 26 or in every other groove that a stripping body engaging in one circumferential groove belongs to one tool stripper 8 and that one engaging in the adjacent next circumferential groove belongs to the other tool stripper 9, although it is preferable to have in each circumferential groove 26 two circumferentially succeeding stripping bodies 28, whose arc spacing measured over the gap 6 exceeds the other arc spacing.

Each stripping body 28 engages with a plate-like area in an approximately axial clearance-free manner in the associated circumferential groove 26 and runs with a concavely curved plate edge in approximately full surface manner or very close to the groove bottom 27. This plate edge transitions two radially outwardly asymmetrically, acute-angled, diverging lateral plate edges in such a way that in the transition area a stripping edge 29 is formed in each case, whereof that edge closer to the working gap 6 and directed against the same has a more acute edge angle or bevel angle than the other stripping edge. The latter stripping edge 29 is directly adjacent to said common axial plane and has with respect to the corresponding stripping edge 29 of the circumferentially adjacent stripping body 28 a gap spacing of only a few radians. These two stripping edges 29 are roughly symmetrical to the common axial plane on the side remote from the working gap 6 and to which are also roughly symmetrical the two stripping edges 29 closer to the working gap 6, whereby said stripping edges can have an arc spacing of approximately 90° or more.

The lateral plate edges forming their free sides form in the vicinity of the material inlet and outlet lateral guide surfaces 36 for the material, the two facing guide surfaces facing one another in funnel-like manner under an acute angle. Therefore the roller core or the groove bottom 27 in the vicinity of the working gap 6 is only exposed over an arc angle of approximately 90°, the guide surfaces 36 being connected approximately tangentially to the groove bottom 27.

As in the engagement area between adjacent tool rings 25, the stripping body 28 has a plate-like construction where it engages in the associated support rod 15, each stripping body 28 has a through planar plate-like construction and can be approximately trapezoidal. In the radially outer area, the stripping body 28 has for the engagement of the support rod 15 a cutout 33, roughly symmetrical to its axial plane and which traverses the base edge remote from the tool rollers 7, 11 and is closely adapted to the associated cross-sectional part of the support rod 15, so that the stripping body 28 in the circumferential direction of the tool roller is guided in substantially clearance-free manner relative to the support rod 15. The base surface of the cutout 33 engages on the associated outer face of the support rod 15, so that the stripping body 28 between said groove bottom 27 and said face is fixed in a substantially clearance-free manner or with only minor clearance with respect to movements in both possible radial directions. However, if the radial spacing between the tool roller and the support rod 15 is increased compared with the operating state, the stripping bodies 28 can be drawn radially from the support rod 15 or reengage thereon in the opposite direction.

Compared with the radial dimension of the support rod 15 each cutout 33 only has roughly half the depth, so that a radially outer area of the rod 15 is cross-sectionally located outside the stripping body 28. The two roughly parallel facing sides of the cutout 33 engage in approximately clearance-free manner on the corresponding lateral, substantially planar outer faces of the support rod 15. Even without an interposed spacing, adjacent stripping bodies 28 can be reciprocally spaced in support-free manner, so that by guiding in the circumferential groove 26 they can be axially automatically oriented in operation by axial displacement with respect to the support rod 15.

All the stripping bodies 28 of each tool roller or all the rollers can be identically constructed, such as workpieces stamped from sheet metal and can be brought into the operating position by inverted mounting on the associated support rod 15.

In certain circumferential grooves of the tool roller 7 or 11, there are none of the described stripping bodies 28 and instead there is a single support member 30, which in the engagement area between adjacent tool rings 25 or in the vicinity of the engagement area of the support rod 15 of two tool strippers 8, 9 or 12, 13 or over its entire surface extension has a planar plate-like construction. The radially inner edge face of said support member 30 is in the form of a concave bearing or support face 31 closely adapted to the outer circumference of the associated portion of the roller core 14 or the groove bottom 27, on which it runs in full-surface manner over an arc angle of approximately 180°. The two lateral edges 37 of the support member 30 connected to said support face 31 and which are at an obtuse angle to one another are slightly set back relative to the associated guide surfaces 36 and steeper and with the support face 31 in each case form one of two sides of an acute-angled stripping edge 32, which is also slightly set back with respect to the working gap 6 of adjacent stripping edges 29 of the stripping body 28. In place of the support face 31 there could also be rolling members, such as rollers, etc.

The bevel angle of said stripping edge 32 is larger than that of the stripping edges 29 closer to the working gap 6 and roughly the same as that of the stripping edges 29 further removed from the working gap 6, so that at least in the vicinity of the stripping edges 32 running on the groove bottom 27 it is acute-angled.

For the support rods of two tool strippers 8, 9 or 12, 13 located on one side of the working gap 6, each support member 30 has cutouts 34 (the details concerning cutouts 33 applying regarding their dimensions) and in which engage in clearance-free manner with their outer circumferential surfaces the two support rods 15. As the profiles of the two support rods are at an angle to one another and therefore define different radial plugging directions, the support member 30 is radially blocked against inwardly directed movements with respect to said rods 15 if the radial spacing of the two rods 15 is correspondingly increased jointly with respect to the associated tool roller 7 or 11. Thus, unlike the stripping bodies 28, the support members 30 cannot be engaged on the support rods 15 in the installation position and instead they must be preassembled with said support rod 15.

Thus, forces acting radially on the support surface 31 are transferred as transverse forces to the support rods 15 of both tool strippers 8, 9 or 12, 13 and there is a reciprocal stiffening. Radially outer edge faces of the support member 30 can, in axial view, be roughly congruent to the associated edge faces of the stripping body 28, but a plate portion of the support member 30 bridges the spacing between the adjacent rods 15. All the support members 30 for one or both tool rollers 7, 11 can be constructed symmetrically to an axial plane in an identical manner and can e.g. be constructed as sheet metal punched articles.

Instead of providing a single support member 30 in the center of the length of the tool roller 7, 11 or a denser distribution of support bodies towards the center of said length, over the length of the tool roller 7 or 11, perhaps four or five support members 30 can be substantially uniformly distributed or given approximately identical intermediate spacings and thereby in each case replace two support bodies 28. The arc angle with which the stripping member 30 encloses the associated roller axis is smaller than the corresponding joint arc angle of two circumferentially succeeding stripping bodies 28 and can be equal to or greater than 180° if measured between the associated stripping edges 29 closer to the working gap 6.

The described blocking action is obtained particularly through the lateral sides of the two cutouts 34 of each support member 30, which are at an angle to one another and which are identical to the cutouts 33. The lateral edges 37 can act as guide surfaces in the same way as the guide surfaces 36. Between each support member 30 and the immediately adjacent stripping bodies 28, there is no need to provide spacers, so that there is no direct axial, reciprocal supporting and instead there is an axial self-orientation of the support member 30, which engages in substantially axial clearance-free manner in the associated circumferential groove 26.

Through the support bodies 14, 15 of in each case one tool unit 11 or 12, the support bodies 15 of in each case two associated tool units 8, 9 or 12, 13 and the support members 30 transversely interconnecting these three spaced support body units is formed a frame with at least three longitudinal beams and several transverse connections interlinking the same radially in spoke-like manner and whose intermediate spacing is greater than that between two, three, four or more adjacent circumferential grooves 26, so that a corresponding number of stripping bodies 28 or pairs of these are located between adjacent support members 30, thereby providing a tool sustainer and a tool interlocking frame. Roughly parallel to the associated axial plane the longitudinal portion of each support rod 15 can perform radially outwardly directed bending deflections in unimpeded manner with respect to the associated stripping bodies 28 or receptacles 34 of the support members 30, because it can pass out of the cutout 33 or 34 in this direction without pulling any of the bodies 28, 30 with it.

Bending deflections of the tool roller 7 or 11 directed away parallel or transversely from the gap plane are transferred via the support members 30 positively directly to support rods 15 of at least two tool strippers 8, 9 or 12, 13 in the form of bending forces and are self-resiliently stored again after freeing from the load by all the associated support bodies 14, 15. The support members 30 like the stripping bodies 28 in the loading direction are dimensionally stiff and not resilient and can thereby form tool stiffeners. It is also conceivable for one to all the stripping bodies 28 or one to all the support bodies 30 to be constructed in one piece with at least one associated support rod 15 or to be connected in positionally fixed manner thereto.

Figure 3:
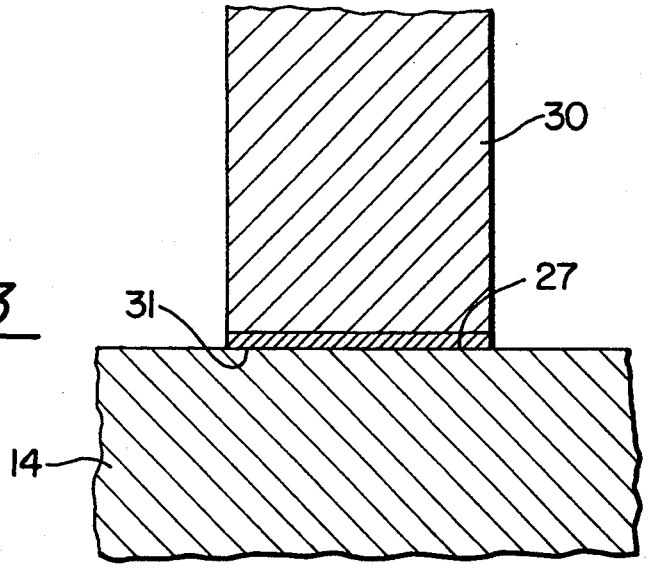
FIG. 3 A sectional view of a roller core engaging a support member with a bearing surface.
Figure 4:
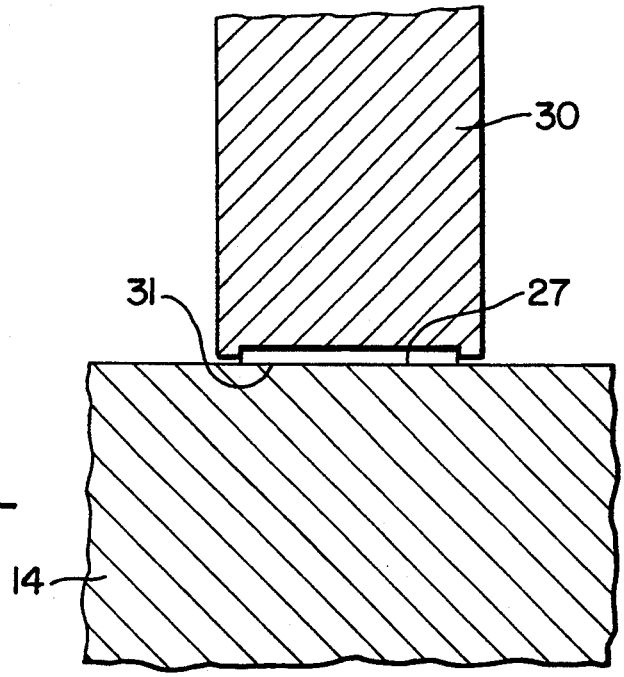
FIG. 4 A sectional view of a roller core engaging a support member with a support face.

The edge face of one to all the stripping bodies 28 running on the groove bottom 27 or the support face 31 of one to all the support members 30 or the lateral faces thereof running on the sides of the tool rings 25 can be partly or completely provided with a sliding coating in the form of a coating of a bearing material, which can be a plastic such as tetrafluoroethylene, thereby providing means for reducing friction. This also applies to the groove bottom 27 or the sides of the tool rings 25. Referring to FIGS. 3 and 4, a sliding coating can provide the bearing surface 31, as shown in FIG. 3, or a roller bearing can provide the support surface 31, as shown in FIG. 4, between the support member 30 and the roller core 13. It can also be appropriate to make one of the two engaging surfaces between the tool roller 7, 11 and the stripping bodies 28 or support members 30 from an inductive or circumferentially substantially uniformly hardened steel and optionally at the other surface from a nitride or surface-hardened steel. This leads to a very favorable pair of bearings, particularly if the tool roller is inductive hardened and the stripping or support body nitride-hardened. This avoids any seizing between the interengaging surfaces, if increased bearing surface pressures occur due to said bending deflections.

Above the working gap 6, there can be a slot or funnel-shaped introduction shaft 35 displaced slightly transversely with respect to the gap 6 in a cover of the casing 2, through which the material to be comminuted can be supplied to the comminuting mechanism 3 only up to a predetermined thickness. The two tool rollers 7, 11 then contrarotate, so that the material is drawn into the working gap 6 and is stripped by the stripping edges 29, 32 on either side close to its outlet and is consequently supplied in free fall to a collecting container below the same.

As soon as there is an excessive resistance torque on the tool rollers 7, 11, e.g. due to clogging or agglomeration of the material, optionally by means of a control mechanism, the contrarotation is stopped or reversed and the material is returned towards the entrance to the working gap 6. It is then stripping by the stripped edges 29, 32 on either side of the entrance and collected between the guide surfaces 36 and the lateral edges 37 until it is conveyed by a further rotation direction reversal through the working gap 6 into the collecting container. Bending deflections of the tool rollers 7 or 11 at right angles to the gap plane of the working gap 6 are transferred in the direction of the associated cross-sectional diagonal to the support rods 15, while the bending deflections directed at an angle inclined to the gap plane with increasing direction angle for both support rods 15 lead to a bending deflection approaching a parallel position to the outer faces of the rods 15 and is parallel to said outer faces with a direction angle of approximately 45°. One support rod 15 is deflected roughly radially, but the other circumferentially of the tool roller, in which it is reinforced in rib-like manner by the positively engaging stripping and support bodies 28, 30. As a function of the requisite characteristics, the indicated features can be provided in random combination in an embodiment.

We claim:

1. A document shredder for shredding at least partially substantially flat materials comprising:

at least one basic structure (4);

at least one comminuting mechanism (3) operatively connected to said at least one basic structure and defining at least one operating gap to be passed by the at least partially substantially flat material;

at least one elongated tool unit (7 to 9 or 11 to 13) extending along said operating gap (6) and providing ends (16, 17);

position securing means (18, 19) for positionally securing at least one of said at least one tool unit with respect to said at least one basic structure (4) in the vicinity of said ends (16, 17); and at least two additional securing means (10) for at least one of said at least one tool-unit (7 to 9 or 11 to 13), said at least two additional securing means (10) being provided between said position securing means (18 or 19) of said at least one tool unit (7 to 9 or 11 to 13), thereby providing a supporting structure for additionally securing said at least one tool unit against stress displacement in the form of bending deformation of at least a section of said at least one tool unit, said at least one tool unit defining at least one additionally supported tool unit, said at least two additional securing means providing means for supportingly engaging said at least one tool unit substantially free or motion play with respect to the stress displacement of said at least one tool unit (7 to 9 or 11 to 13) during a non-stress state of said at least one tool unit (7 to 9 or 11 to 13) free from stress that causes stress displacement, and a number of said at least two additional securing means (10) distributingly engaging over a substantially entire length extension of at least one of said at least one tool unit, said length extension being defined by an extension between said ends (16, 17).

2. The document shredder according to claim 1, wherein at least one of said at least one additional securing means (10) is provided for additionally supporting at least one of said at least one tool unit (7 to 9 or 11 to 13) with respect to said at least one basic structure (4) substantially free of motion play.

3. The document shredder according to claim 1, wherein at least one of said at least one additional securing means (10) is spaced from at least one of said at least one of said position securing means (18, 19), at least one of said additional securing means being provided for holding a gap width defined by at least one of said operating gap (6) substantially constant under all operating conditions occurable.

4. The document shredder according to claim 1, wherein at least one of said at least one additional securing means (10) is a sustainer bearing substantially supportingly engaging at least one of said tool unit when free of operating load, at least one of said at least one additionally supported tool unit being operationally movable relative to said at least one additional securing means (10) to perform an operating motion.

5. The document shredder according to claim 1, wherein in a non-assembled state at least one of said at least one tool unit provides a freely accessible external face, at least one of said at least one additional securing means supportingly engaging at least one of said at least one tool unit (7 to 9 or 11 to 13) on said external face with a supporting pressure.

6. The document shredder according to claim 1, wherein at least one of said at least one tool unit provides at least one of a tool roller (7, 11) and a tool stripper (8, 9, 12, 13), at least one of said at least one additional securing means (10) being provided during the non-stressed state of said tool unit, at least one of means for sustaining at least one of said at least one tool unit, means for additionally stiffening at least one of said at least one tool unit, means for interblocking at least one of said at least one tool unit, means for reducing friction of said at least one tool unit, a complementary hardening of interengaging tool surfaces, a sliding coating on interengaging tool surfaces and roller bearing means.

7. The document shredder according to claim 1, wherein at least two of said at least one tool unit are provided in a substantially parallel and interspaced positioning; for providing at least one of said additional securing means (10), at least two of said at least two tool units (7 to 9 or 11 to 13) being combined via at least one transverse connection, thereby providing a stiffening structure at least partially similar to a continuous frame, said stiffening structure being substantially free of motion play with respect to the stress displacement.

8. The document shredder according to claim 1, wherein at least one counterbearing face (27) is provided, at least one of said at least one additional securing means (10) having at least one support surface (31) running substantially clearance-free as a bearing surface on at least one of said at least one counterbearing face (27), thereby supporting said counterbearing face (27) with respect to at least one of said basic structure (4) substantially free of motion play.

9. The document shredder according to claim 8, wherein said at least one additional securing means has interengaging support faces and counter faces, at least one of said support faces and counter faces (31, 27, 33, 34) being at least partially provided by a coating of at least one sliding material.

10. The document shredder according to claim 8, wherein at least one of said at least one support surface (31) is made from nitride-hardened steel.

11. The document shredder according to claim 1, wherein at least one of said at least one tool unit (7, 11) has a circumferential face, at least one of said at least one additional securing means (10) having at least one shell surface running on said at least one circumferential face, thereby supporting said circumferential face with respect to at least one of said at least one basic structure substantially free of motion play.

12. The document shredder according to claim 1, wherein at least one of said at least one additional securing means (10) has at least one support member (30) arranged substantially free of motion play with respect to the stress displacement.

13. The document shredder according to claim 12, wherein at least one of said at least one support member (30) is substantially provided by a plate.

14. The document shredder according to claim 12, wherein at least one of said at least one support member (30) has remote edge faces located substantially in a single plane and supportingly engaging in substantially clearance-free manner on a number of said at least one tool unit provided by three tool units (7 to 9 or 11 to 13), spaced from one another, when said edge faces are free from operating load.

15. The document shredder according to claim 14, wherein two of said three tool units (7 to 9 or 11 to 13) are formed by holding rods (15) for at least one stripping body (28) and a third one of said three tool units is formed by a substantially cylindrical roller core (14) of a tool roller (7, 11) rotatably mounted on said at least one basic structure (4).

16. The document shredder according to claim 14, wherein in cross-section said three tool units (7 to 9 or 11 to 13) are located in the vicinity of angles of an imaginary triangle.

17. The document shredder according to claim 1, wherein at least one of said additional securing means (10) for one of said at least one tool unit has at least two substantially interspaced first and second support rods (14, 15) providing rod ends (16, 17) operationally fixedly connected to at least one of said at least one basic structure, said at least one additional securing means (10) having at least one support member (30), said first support rod (14, 15) being directly supported on said at least one basic structure (4) only in two longitudinally spaced areas in the vicinity of said rod ends (16, 17) and being supported between said spaced areas via at least one of said at least one support member (30) on said second support rod (14, 15).

18. The document shredder according to claim 17, wherein at least two support members (30) are provided as separate and interspaced members between said areas, said support bodies (30) being constructed substantially identical.

19. The document shredder according to claim 1, wherein at least one of said at least one additional securing means (10) has interengaging support faces and counter faces (31, 27, or 33, 34) at least partly made from substantially frictionless sliding materials of a bearing material coupling.

20. The document shredder according to claim 1, wherein at least one of said at least one additional securing means (10) has interengaging support faces and counter faces (31, 27 or 33, 34), a first one of said faces comprising an inductively hardened material and a second one of said faces comprising a nitride-hardened material.

21. The document shredder according to claim 1, further comprising at least two separate stripping bodies (28), said at least two separate stripping bodies being located substantially in a common plane and provided around a roller axis (20) of at least one of said at least one tool unit (7, 11).

22. The document shredder according to claim 1, wherein at least one of said at least one additional securing means (10) has at least two interspaced holding rods (15) located substantially parallel to one another and to at least one of said at least one tool unit (7,11), at least one of said at least two holding rods (15) defining a longitudinal extension and having at least one of configurations provided by an at least partly angular cross section by an arrangement substantially symmetrical to an axial plane of at least one of said at least one tool unit (7,11), by an arrangement facing at least one of said at least one tool unit (7,11) with a substantially planar side, by an arrangement with only a gap spacing from an outer circumference of at least one of said at least one tool unit (7, 11) and by having an external circumference engaging in at least one edge open cutout (34,33) of at least one of members defined by at least one support body (30) of said at least one additional support means (10) and at least one stripping body (28) strippingly engaging at least one of said at least one tool unit (7,11), at least one of said members engaging longitudinally displaceable on said external circumference but engaging on said external circumference substantially clearance-free with respect to a direction transverse to said longitudinal extension.

23. The document shredder according to claim 22, wherein at least two of said at least two holding rods (15) have at least one of configurations defined by identical construction, by reciprocal displacement by substantially 90° relative to an axis (20) of at least one of said at least one tool unit (7,11) and by having substantially equal radial spacings from said axis (20).

24. The document shredder according to claim 1, wherein at least one stripping body (28) is provided by at least two separate stripping bodies (28) located substantially in a common plane and provided around a roller axis (20) of at least one of said at least one tool unit (7,11).

25. A document shredder for shredding at least partially substantially flat materials comprising:

at least one basic structure (4);

at least one comminuting mechanism (3) operatively connected to said at least one basic structure and defining at least one operating step (6) to be passed by the flat materials;

at least one elongated tool unit (7 to 9 or 11 to 13) extending along said operating gap (6) and providing ends (16, 17); position securing means (18, 19) for postionally securing at least one of said at least one tool unit with respect to said at least one basic structure (4) in the vicinity of said ends (16, 17); and at least one additional securing means (10) for at least one of said at least one tool unit (7 to 9 or 11 to 13), said at least one additional securing means (10) being provided between said position securing means (18 or 19) of said at least one tool unit (7 to 9 or 11 to 13), thereby providing a supporting structure for additionally securing said at least one tool unit against stress displacement similar to bending deformation of at least a section of said at least one tool unit defining at least one additionally supported tool unit, said supporting structure being substantially free of motion play with respect to the stress displacement of said at least one tool unit (7 to 9 or 11 to 13) during a state of said at least one tool unit (7 to 9 or 11 to 13) free from stress causing the stress displacement, wherein at least one counterbearing face (27) is provided, at least one of said at least one additional securing means (10) having at least one support surface (31) running substantially clearance-free as a bearing surface on at least one of said at least one counterbearing face (27), thereby supporting said counterbearing face (27) with respect to at least one of said basic structure (4) substantially free of motion play, wherein at least one of said at least one tool unit has at least two spaced tool rings (25), at least one of said at least one support surface providing at least one of arrangements defined by engaging axially in substantially clearance-free manner between at least two of said at least two tool rings (25), by extending over an arc angle of approximately 180° around an axis (20) of said at least one tool unit, by forming at at least one end of said at least one support surface a stripping edge (32) for a groove bottom (27) of an annular groove (26) of said at least one tool unit (7, 11), and by being located substantially symmetrically to an axial plane of said at least one tool unit (7, 11), said axial plane extending at right angles to at least one of said at least one operating gap (6).

26. A document shredder for shredding at least partially substantially flat materials comprising:

at least one basic structure (4);

at least one comminuting mechanism (3) operatively connected to said at least one basic structure and defining at least one operating gap to be passed by the at least partially substantially flat material;

at least one elongated tool unit (7 to 9 or 11 to 13) extending along said operating gap (6) and providing ends (16, 17);

position securing means (18, 19) for positionally securing at least one of said at least one tool unit with respect to said at least one basic structure (4) in the vicinity of said ends (16, 17);

at least one additional securing means (10) for at least one of said at least one tool unit (7 to 9 or 11 to 13), said at least one additional securing means (10) being provided between said position securing means (18 or 19) of said at least one tool unit (7 to 9 or 11 to 13), thereby providing a supporting structure for additionally securing said at least one tool unit against stress displacement in the form of bending deformation of at least a section of said at least one tool unit, said at least one tool unit defining at least one additionally supported tool unit, said at least one additional securing means providing means for supportingly engaging said at least one tool unit substantially free of motion play with respect to the stress displacement of said at least one tool unit (7 to 9 or 11 to 13) during a non-stress state of said at least one tool unit (7 to 9 or 11 to 13) free from stress that causes stress displacement; and at least one of said at least one additional securing means (10) having at least two interspaced holding rods (15) located substantially parallel to one another and to at least one of said at least one tool unit (7, 11), at least one of said at least two holding rods (15) defining a longitudinal extension and having at least one of configurations provided by an at least partially angular cross-section, by an arrangement substantially symmetrical to an axial plane of at least one of said at least one tool unit (7, 11), by an arrangement facing at least one of said at least one tool unit (7, 11) with a substantially planar side, by an arrangement with only a gap spacing from an outer circumference of at least one of said at least one tool unit (7, 11), by having an external circumference engaging in at least one open cutout (34, 33) of at least one of members defined by at least one support body (30) of said at least one additional support means (10), and at least one stripping body, strippingly engaging at least one of said at least one tool unit (7, 11), with at least one of said members engaging longitudinally displaceably on said external circumference, but engaging on said external circumference, but engaging on said external circumference substantially clearance-free with respect to a direction transverse to said longitudinal extension.

27. The document shredder according to claim 26, wherein at least two of said at least two holding rods (15) have at least one of configurations defined by identical construction, by reciprocal displacement by substantially 90° relative to an axis (20) of at least one of said at least one tool unit (7, 11) and by having substantially equal radial spacings from said axis (20).

28. The document shredder according to claim 26, wherein at least one tool stripper (8, 9 or 12) having at least one stripper body (28) for strippingly engaging at least one of said at least one tool unit is provided for one of said tool unit, at least one of said at least one additional securing means (10) having at least one of said at least two holding rods (15) and at least one support member (30) reciprocally sustaining at least two of said at least one tool unit, at least one of said support rod (15) supportingly bearing both at least one of said at least one stripping body (28) and at least one of said at least one support member (30), at least one of said at least one stripping body (28) having a shape significantly different from at least one of said at least one support member (30).

29. The document shredder according to claim 26, wherein at least one stripping body (28) is provided by at least two separate stripping bodies (28) located substantially in a common plane and provided around a roller axis (20) of at least one of said at least one tool unit (7, 11).

30. A document shredder for shredding at least partially substantially flat materials comprising:

at least one basic structure (4);

at least one comminuting mechanism (3) operatively connected to said at least one basic structure and defining at least one operating gap to be passed by the at least partially substantially flat material;

at least one elongated tool unit (7 to 9 or 11 to 13) extending along said operating gap (6) and providing ends (16, 17);

position securing means (18, 19) for positionally securing at least one of said at least one tool unit with respect to said at least one basic structure (4) in the vicinity of said ends (16, 17); and at least one additional securing means (10) for at least one of said at least one tool unit (7 to 9 or 11 to 13), said at least two additional securing means (10) being provided between said position securing means (18 or 19) of said at least one tool unit (7 to 9 or 11 to 13), thereby providing a supporting structure for additionally securing said at least one tool unit against stress displacement in the form of bending deformation of at least a section of said at least one tool unit, said at least one tool unit defining at least one additionally supported tool unit, said at least one additional securing means providing means for supportingly engaging said at least one tool unit substantially free of motion play with respect to the stress displacement of said at least one tool unit (7 to 9 or 11 to 13) during a non-stress state of said at least one tool unit (7 to 9 or 11 to 13) free from stress that causes stress displacement, with at least one of said at least one additional securing means (10) having at least one support member (30) making up said means for supportingly engaging, which is arranged substantially free of motion play with respect to the stress displacement, at least one of said at least one support member (30) having remote edges located substantially in a single plane and supportingly engaging in substantially clearance-free manner on a number of said at least one tool unit made up of three tool units (7 to 9 or 11 to 13), spaced from one another, when said edge faces are free from operating load, two of said three tool units (7 to 9 or 11 to 13) being formed by holding rods (15) for at least one stripping body (28), and a third one of said three tool units being formed by a cylindrical roller core (14) of a tool roller (7, 11) routably mounted on said at least one basic structure (4); and said at least one of said stripping body (28) comprising at least two substantially equal and separate stripping bodies (28) located substantially in a common plane and provided around a roller axis (20) of at least one of said at least one tool unit (7, 11).

31. The document shredder according to claim 30, wherein at least two of said at least two stripping bodies (28) have at least one of configurations provided by arrangement on separate support rods (15), by a common extension over an arc angle greater than an arced extension angle of a support face (31) of at least one of said at least one support member (30), by a common extension over more than 180° and by providing a pair of juxtaposed first stripping edges (29) located with respect to a circumferential direction between stripping edges (32) provided by at least one of said at least one support member (30), said at least one support member (30) being located axially adjacent to said at least one stripping body (28).

32. A document shredder for shredding at least partially substantially flat materials comprising:

at least one basic structure (4);

at least one comminuting mechanism (3) operatively connected to said at least one basic structure and defining at least one operating gap to be passed by the at least partially substantially flat material;

at least one elongated tool unit (7 to 9 or 11 to 13) extending along said operating gap (6) and providing ends (16, 17), at least one of said at least one tool unit (7, 11) having a circumferential face;

position securing means (18, 19) for positionally securing at least one of said at least one tool unit with respect to said at least one basic structure (4) in the vicinity of said ends (16, 17);

at least one additional securing means (10) for at least one of said at least one tool unit (7 to 9 or 11 to 13), at least one of said at least one additional securing means (10) having at least one shell surface running on said at least one circumferential face of said at least one of said at least one tool unit (7, 11), thereby supporting said circumferential face with respect to at least one of said at least one basic structure substantially free of motion play, and said at least one additional securing means (10) being provided between said position securing means (18 or 19) of said at least one tool unit (7 to 9 or 11 to 13), thereby providing a supporting structure for additionally securing said at least one tool unit against stress displacement in the form of bending deformation of at least a section of said at least one tool unit, said at least one tool unit defining at least one additionally supported tool unit, said at least one additional securing means providing means for supportingly engaging said at least one tool unit substantially free of motion play with respect to the stress displacement of said at least one tool unit (7 to 9 or 11 to 13) during a non-stress state of said at least one tool unit (7 to 9 or 11 to 13) free from stress that causes the stress displacement; and at least one of said at least one tool unit having at least two spaced tool rings (25), at least one of said at least one shell surface providing at least one of arrangements defined by engaging axially in substantially clearance-free manner between at least two of said at least two tool rings (25), by extending over an arc angle of approximately 180° around an axis (20) of said at least one tool unit, by forming at least one end of said at least one surface stripping edge (32) for a groove bottom (27) of an annular groove (26) of said at least one tool unit (7, 11) and by being located substantially symmetrically to an axial plane of said at least one tool unit (7, 11), said axial plane extending at right angles to at least one of said at least one operating gap (6).

* * * * *

UNITED STATES PATENT AND TRADEMARK OFFICE

CERTIFICATE OF CORRECTION

PATENT NO. : 5,409,171

DATED : April 25, 1995

INVENTOR(S) : Stangenberg et al

It is certified that error appears in the above-indentified patent and that said Letters Patent is hereby corrected as shown below:

Column 2, line 60, after "means" insert --can--.

Column 5, line 60, replace "cannon" with --common--.

Column 6, line 24, after "transitions" insert --to--.

Column 10, line 26, replace "or" with --of--.

Column 13, line 19, replace "step" with --gap--.

Column 16, line 1, "routably" should read —rotatably—

Signed and Sealed this

Twenty-seventh Day of February, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,409,171
DATED : April 25, 1995
INVENTOR(S) : Stangenberg, et al

It is certified that error appears in the above-indentified patent and that said Letters Patent is hereby corrected as shown below:

Title page, item [73] Assignee: should read -- Schleicher International Aktiengesellschaft --.

Signed and Sealed this

Twenty-third Day of July, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,409,171

DATED : April 25, 1995

INVENTOR(S) : Stangenberg et al.

It is certified that error appears in the above-indentified patent and that said Letters Patent is hereby corrected as shown below:

On the title page, item [73], "Schleiche & Co. International Aktiengesellschaft" should read --Schleicher & Co. International Aktiengesellschaft--.

Column 2, line 60, after "means" insert --can--.

Column 5, line 60, replace "cannon" with --common--.

Column 6, line 24, after "transitions" insert --to--.

Column 10, line 26, replace "or" with --of--.

Column 13, line 19, replace "step" with --gap--.

Column 16, replace "routably" with --rotatably--.

This Certificate supersedes Certificate of Correction issue July 23, 1996.

Signed and Sealed this

Twenty-ninth Day of October 1996

Bruce Lehman

BRUCE LEHMAN

*Commissioner of Patents and Trademarks*

*Attest:*

*Attesting Officer*